US006820629B2

(12) United States Patent
Tseng

(10) Patent No.: US 6,820,629 B2
(45) Date of Patent: Nov. 23, 2004

(54) LEG ASSEMBLY FOR A CANOPY

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 100 days.

(21) Appl. No.: 10/283,655

(22) Filed: Oct. 30, 2002

(65) Prior Publication Data

US 2004/0084073 A1 May 6, 2004

(51) Int. Cl.[7] ..... E04H 15/48
(52) U.S. Cl. ..... 135/152; 135/157; 108/179
(58) Field of Search ..... 135/114, 143, 135/151–152, 157–160; 108/42, 162, 166, 175, 179, 183; 52/79.5, 646; 211/144, 195

(56) References Cited

U.S. PATENT DOCUMENTS 1,654,409 A * 12/1927 Browne ..... 108/29
1,958,296 A * 5/1934 Crow ..... 135/143
3,169,543 A * 2/1965 McGerty ..... 135/152
3,550,601 A * 12/1970 Peters ..... 135/152
3,769,772 A * 11/1973 Oetiker ..... 52/646
3,830,170 A * 8/1974 Faulstich ..... 108/162
4,948,289 A * 8/1990 Dellinger ..... 135/159
5,167,246 A * 12/1992 Mortenson ..... 135/143
5,706,533 A * 1/1998 Opheim et al. ..... 5/99.1
5,758,196 A * 5/1998 Laing ..... 135/157
5,802,778 A * 9/1998 Thorp et al. ..... 52/79.4

FOREIGN PATENT DOCUMENTS

JP 2001182382 A * 7/2001

* cited by examiner

*Primary Examiner*—Lanna Mai
*Assistant Examiner*—Hanh V. Tran
(74) *Attorney, Agent, or Firm*—Ladas & Parry LLP

(57) ABSTRACT

A leg assembly includes at least three upright support members and at least three horizontal link members. Each of the support members includes an adjacent pair of planar first and second leg frames that are connected pivotally to each other, and at least one connecting plate disposed between the first and second leg frames so as to form an angle between the first and second leg frames such that the first and second leg frames can stand stably on a ground surface. Each of the link members is connected detachably to an adjacent pair of the support members so as to interconnect and position the support members relative to one another.

2 Claims, 8 Drawing Sheets

LEG ASSEMBLY FOR A CANOPY

BACKGROUND OF THE INVENTION

1. Field of the Invention

The invention relates to a leg assembly, more particularly to a leg assembly for a canopy.

2. Description of the Related Art

Referring to FIG. 1, a conventional leg assembly 1 for a canopy 10 is shown to include four upright leg members 11, and four connecting units 12, each of which extends between an adjacent pair of the leg members 11, and includes first and second linking rods 121. The first and second linking rods 121 of each connecting unit 12 cooperatively form an X-shaped formation when the leg assembly 1 is unfolded so as to support the canopy 10 and are adjacent to one another when the leg assembly 1 is folded so as to facilitate storage of the leg assembly 1.

Although the aforesaid conventional leg assembly 1 can achieve its intended purpose, in actual use, the leg assembly 1 cannot support stably the canopy 10 due to the presence of only one leg member 11 at each corner of the leg assembly 1.

SUMMARY OF THE INVENTION

Therefore, the main object of the present invention is to provide a leg assembly that is capable of overcoming the aforementioned drawback of the prior art.

According to the present invention, a leg assembly is used for mounting a canopy thereon, and comprises at least three upright support members and at least three horizontal link members. Each of the support members includes an adjacent pair of planar first and second leg frames that are connected pivotally to each other, and at least one connecting plate disposed between the first and second leg frames so as to be adapted to position the first and second leg frames relative to a ground surface. Each of the first and second leg frames includes a vertical pivot side and a vertical free side opposite to the pivot side, and is rotatable about a vertical axis between unfolded and folded positions. In the unfolded position, the free sides of each adjacent pair of the first and second leg frames are spaced apart from each other so as to form an angle therebetween. In the folded position, the free sides of each adjacent pair of the first and second leg frames are close to each other. Each of the link members is connected detachably to an adjacent pair of the support members so as to interconnect and position the support members relative to one another.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
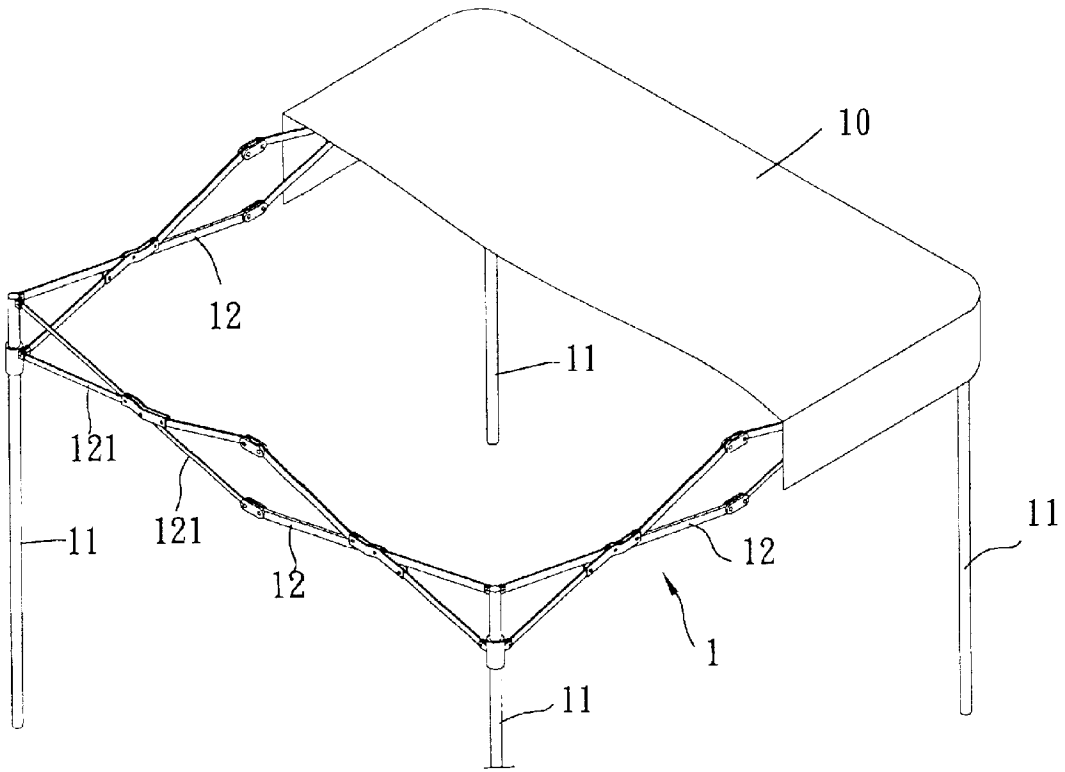
FIG. 1 PRIOR ART
FIG. 1 is a perspective view of a conventional leg assembly, in which a portion of a canopy is removed for the sake of clarity.
Figure 2:
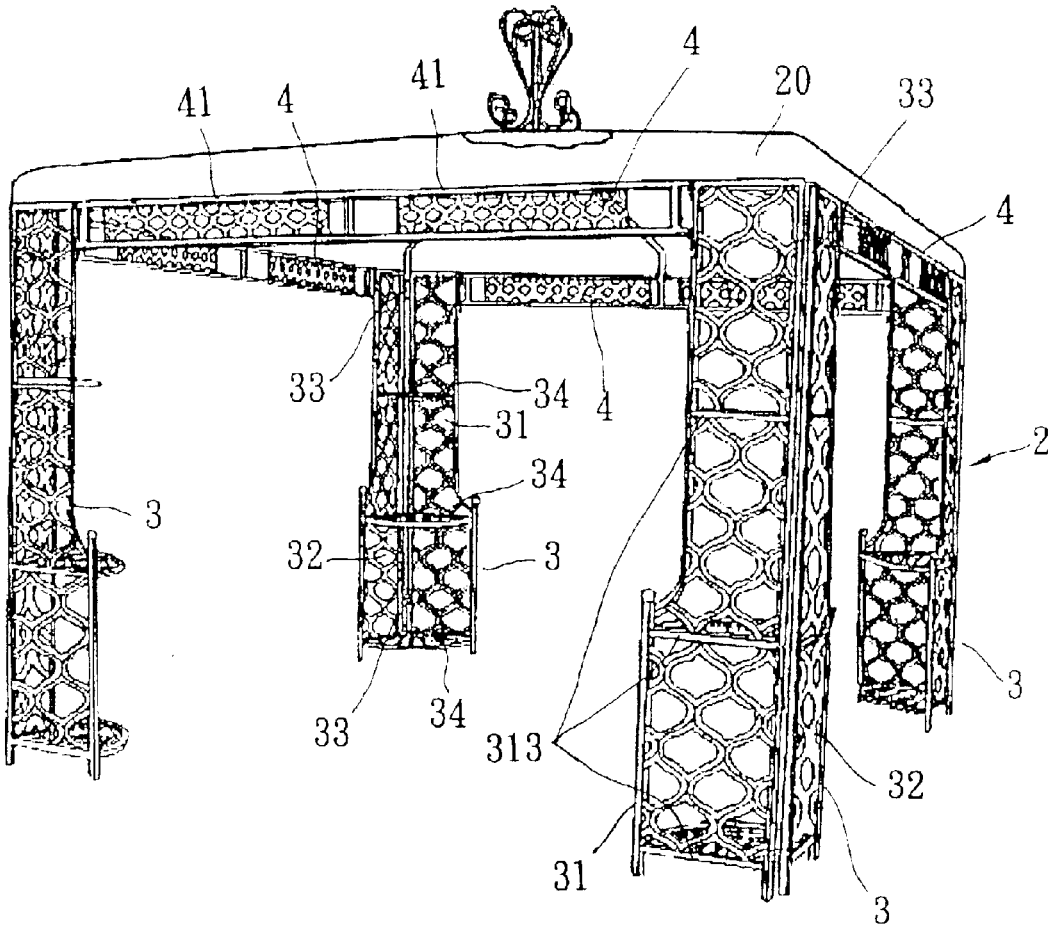
FIG. 2 is a perspective view of the preferred embodiment of a leg assembly according to the present invention.
Figure 3:
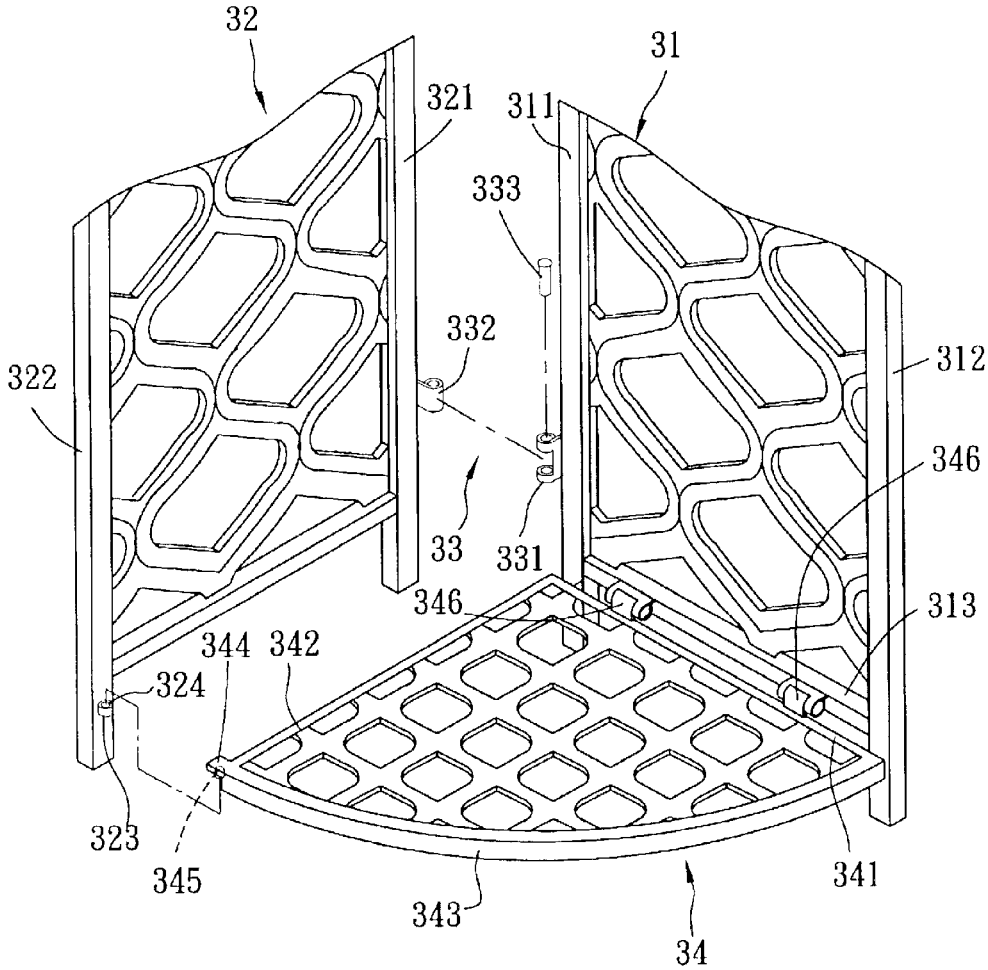
FIG. 3 is a partly exploded fragmentary perspective view to illustrate a support member of the preferred embodiment.

Referring to FIGS. 2 and 3, the preferred embodiment of a leg assembly 2 according to the present invention is used for mounting a canopy 20 thereon, and is shown to comprise four upright support members 3 and four horizontal link members 4.

Figure 4:
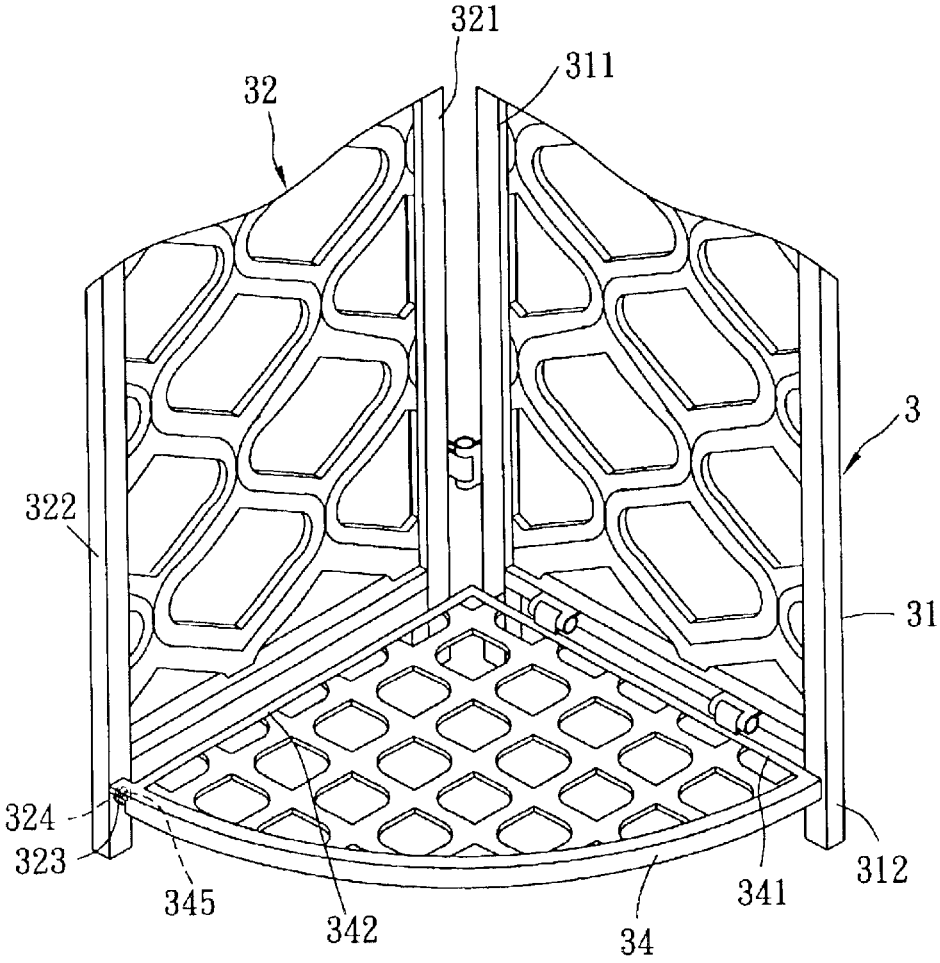
FIG. 4 illustrates two leg frames and a connecting plate of the support member of FIG. 3 in an assembled state.
Figure 5:
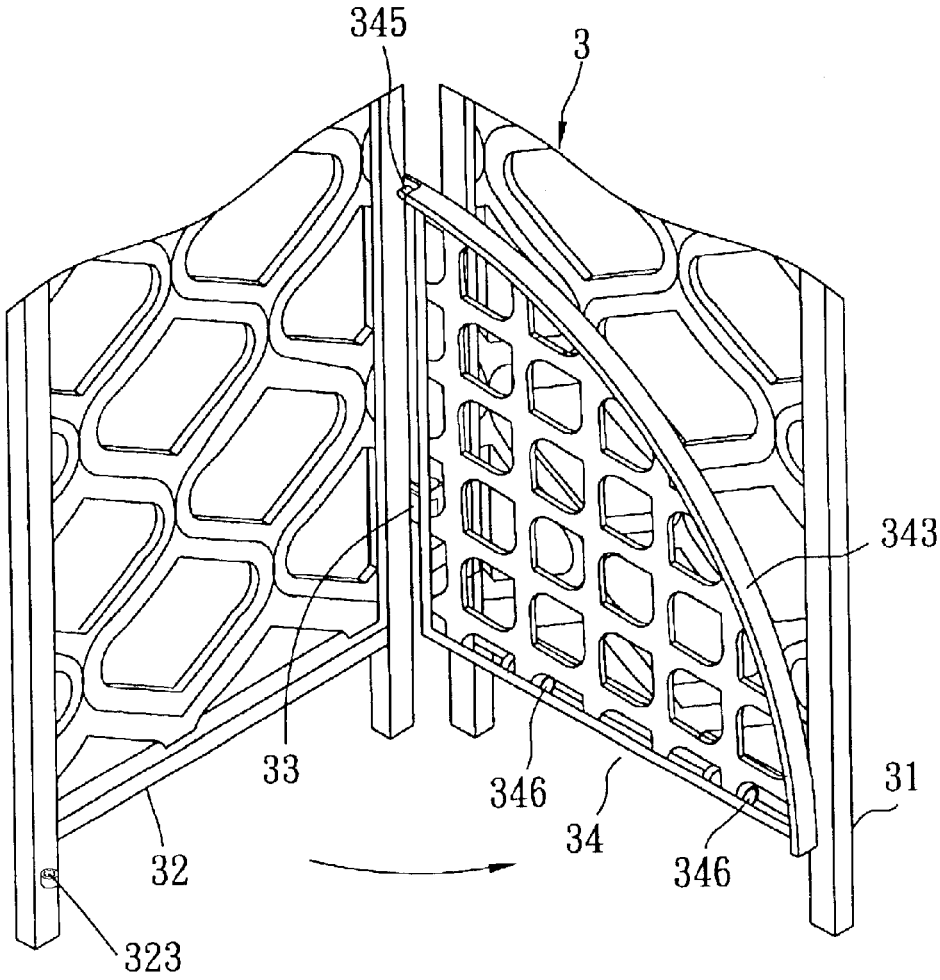
FIG. 5 illustrates how the connecting plate of the support member of FIG. 3 is folded.

Each of the support members 3 includes an adjacent pair of planar first and second leg frames 31, 32 that are connected pivotally to each other, upper and lower pivot assemblies 33, and three spaced-apart horizontal connecting plates 34. Each of the first and second leg frames 31, 32 includes a vertical pivot side 311, 321 and a vertical free side 312, 322 opposite to the pivot side 311, 321, and is rotatable about a vertical axis between unfolded and folded positions. In the unfolded position, as best illustrated in FIG. 4, the free sides 312, 322 of the first and second leg frames 31, 32 are spaced apart from each other. In the folded position, as best illustrated in FIG. 5, the free sides 312, 322 of the first and second leg frames 31, 32 are close to each other. The first leg frame 31 of each of the support members 3 further includes three integral horizontal bars 313 (see FIG. 2) that are spaced apart from each other along the length of the first leg frame 31. The second leg frame 32 of each of the support members 3 further includes three positioning units 323 (only one is shown in FIGS. 3 to 5) that are spaced apart from each other along the length of the second leg frame 32. Each of the positioning units 323 is proximate to the free side 322 of the respective second leg frame 32, and includes an insert hole 324.

Each of the upper and lower pivot assemblies 33 (only the lower pivot assembly 33 is shown in FIGS. 3 to 5) of each support member 3 interconnects rotatably the pivot sides 311, 321 of the corresponding first and second leg frames 31, 32, and includes two pivot seats 331, 332, each of which is connected fixedly to a respective one of the pivot sides 311, 321 of the corresponding first and second leg frames 31, 32, and a pivot pin 333 extending through the pivot seats 331, 332 so that each of the first and second leg frames 31, 32 can rotate about the vertical axis. The pivot assemblies 33 used in this embodiment are similar in construction to those usually applied on doors.

Each of the connecting plates 34 (only one is shown in FIGS. 3 to 6) is disposed between the first and second leg frames 31, 32 of the corresponding support member 3 so as to be adapted to position the first and second leg frames 31, 32 relative to a ground surface, is shaped as a circular sector, and includes a straight pivot side 341 connected pivotally to a respective one of the horizontal bars 313 of the first leg frame 31, a straight linking side 342 perpendicular to the straight pivot side 341, a curved side 343 interconnecting the straight pivot and linking sides 341, 342, and a pair of spaced-apart rotatable units 346. The straight linking side 342 is provided with an integral projection 344 that extends toward a corresponding second leg frame 32, and a positioning pin 345 that extends downwardly from the projection 344 and that engages detachably the insert hole 324 in the respective positioning unit 323 of the corresponding second leg frame 32 when the first and second leg frames 31, 32 of the corresponding support member 3 are at the unfolded position. The pair of rotatable units 346 connect pivotally the straight pivot side 341 of a corresponding connecting plate 34 to the respective horizontal bar 313 of the corresponding first leg frame 31. The structure of the rotatable units 346 is substantially similar to that of the pivot assemblies 33 of the support members 3.

The positioning pins 345 are turnable to disengage from the insert holes 324 in the positioning units 323, as best illustrated in FIG. 5, so that the connecting plates 34 (only one is shown in FIG. 5) can rotate to abut against the corresponding first leg frame 31, thereby permitting folding of the second leg frames 32 on the first leg frames 31 when the link members 4 are removed from the support members 3.

Figure 7:
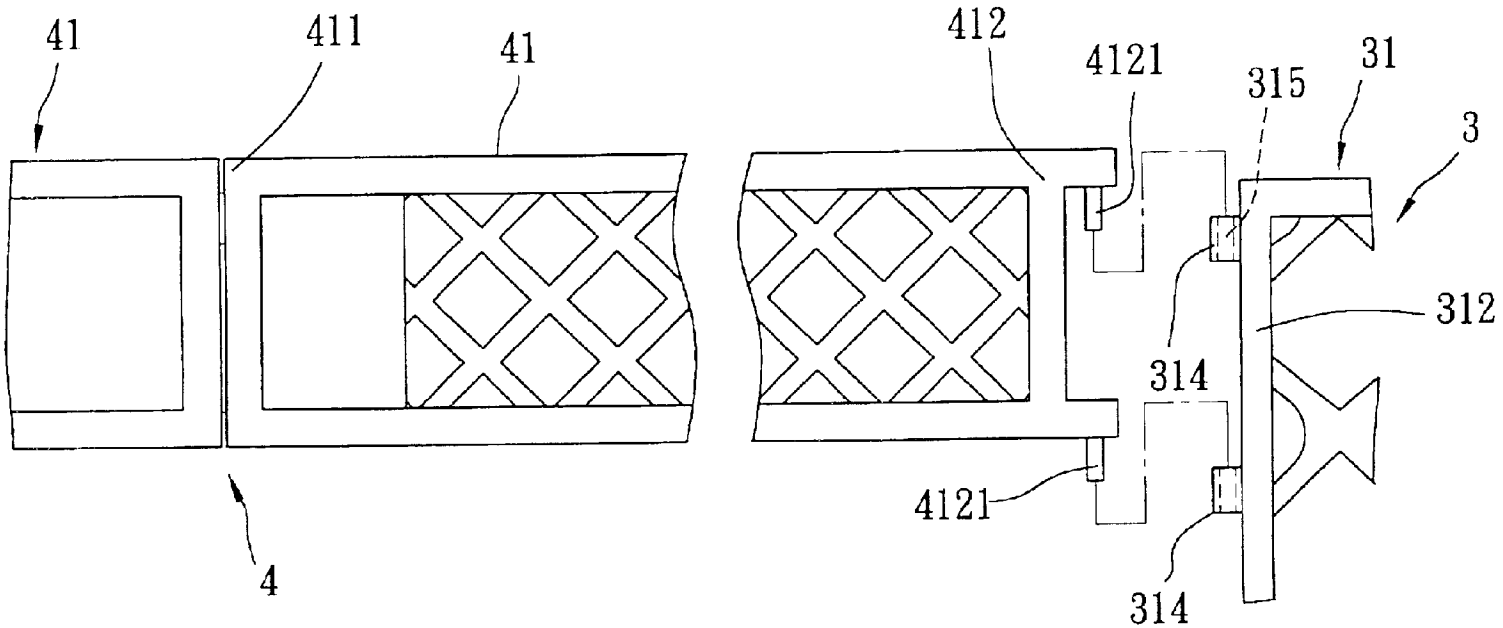
FIG. 7 is a fragmentary schematic view of a horizontal link member of the preferred embodiment, illustrating how the horizontal link member is connected to the leg frame of an adjacent support member.
Figure 8:
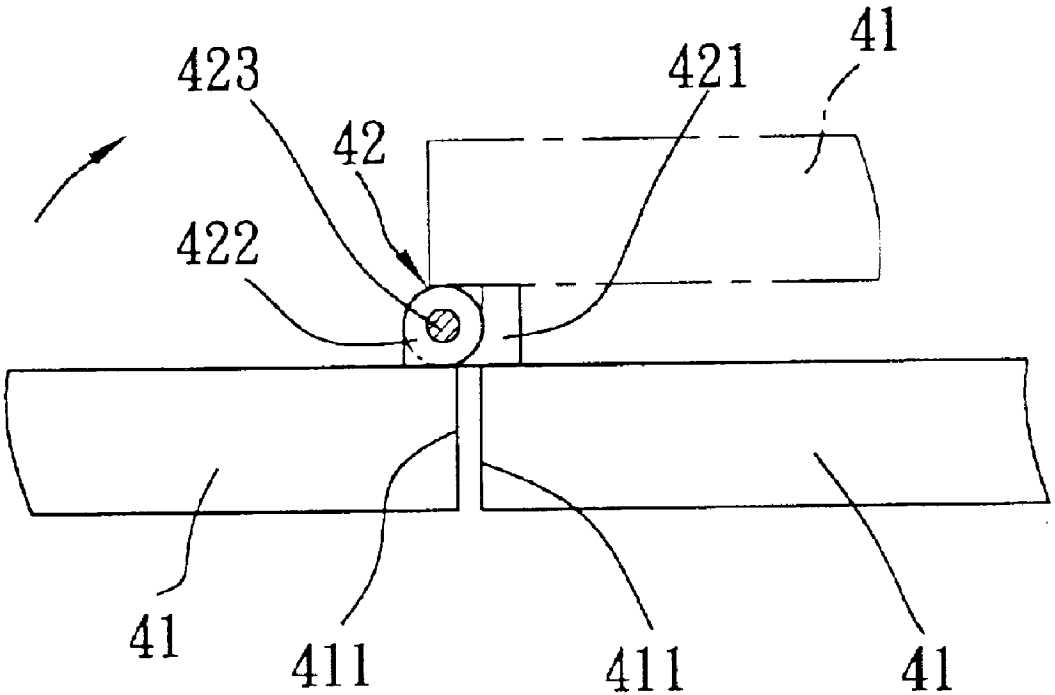
FIG. 8 illustrates how vertical plates of the horizontal link member of FIG. 7 can be folded, as shown in phantom lines.

Referring to FIGS. 3, 7 and 8, each of the horizontal link members 4 is connected detachably to an adjacent pair of the support members 3 so as to interconnect and position the support members 3 relative to one another, and includes a pair of vertical plates 41, which are aligned with each other along a horizontal direction, and a turnable unit 42 (see FIG. 8) for interconnecting pivotally the vertical plates 41. Each of the vertical plates 41 has a pivot end 411 and an engaging end 412 opposite to the pivot end 411. The turnable unit 42 of each link member 4 includes upper and lower first pivot seats 421 (only one is visible in FIG. 8) fixed on the pivot end 411 of one of the vertical plates 41, a second pivot seat 422 fixed on the pivot end 411 of the other one of the vertical plates 41, and a pivot pin 423 extending through the first and second pivot seats 421, 422 of the turnable unit 42 of a respective one of the link members 4 so that the pivot ends 411 of the vertical plates 41 of each link member 4 are connected pivotally to each other. As such, when the link members 4 are removed from the support members 3, the left vertical plate 41 can rotate relative to the right vertical plate 41 from an unfolded position shown in solid lines in FIG. 8 to a folded position shown in phantom lines in FIG. 8. The engaging end 412 of each of the vertical plates 41 is formed integrally with two downwardly extending insert pins 4121. The free side 312, 322 of each of the first and second leg frames 31, 32 of the support members 3 is formed integrally with two lugs 314 (only the free side 312 of the first leg frame 31 is shown in FIG. 7), each of which has a vertical hole 315 for receiving a respective one of the insert pins 4121 therein, thereby attaching detachably the vertical plates 41 of the link members 4 to a respective adjacent pair of the support members 3.

During assembly, each of the support members 3 are unfolded on the ground surface, after which the positioning pins 345 on the connecting plates 34 of the respective support member 3 are inserted into the insert holes 324 in the positioning units 323 of the second leg frame 32 of the respective support member 3. At this moment, the first and second leg frames 31, 32 of each of the support members 3 form a 90° intersecting angle such that the pivot sides 311, 321 of the first and second leg frames 31, 32 of each of the support members 3 are adjacent to each other, and the free sides 312, 322 of the first and second leg frames 31, 32 of each of the support members 3 are spaced apart from each other. Furthermore, the lower end of each of the support members 3 forms a triangular leg support that stands stably on the ground surface. Each of the link members 4 is then connected to the adjacent pair of the support members 3 by inserting the insert pins 4121 on the vertical plates 41 of each link member 4 into the vertical holes 315 in the lugs 314 of the free sides 312, 322 of the first and second leg frames 31, 32 of the adjacent support member 3. The leg assembly 2 can now be mounted with the canopy 20, as shown in FIG. 2. The connecting plates 34 of each of the support members 3 can be used for disposal of various articles, preferably having relatively heavy weights, so as to enhance stability of the support members 3 in the unfolded state.

Figure 6:
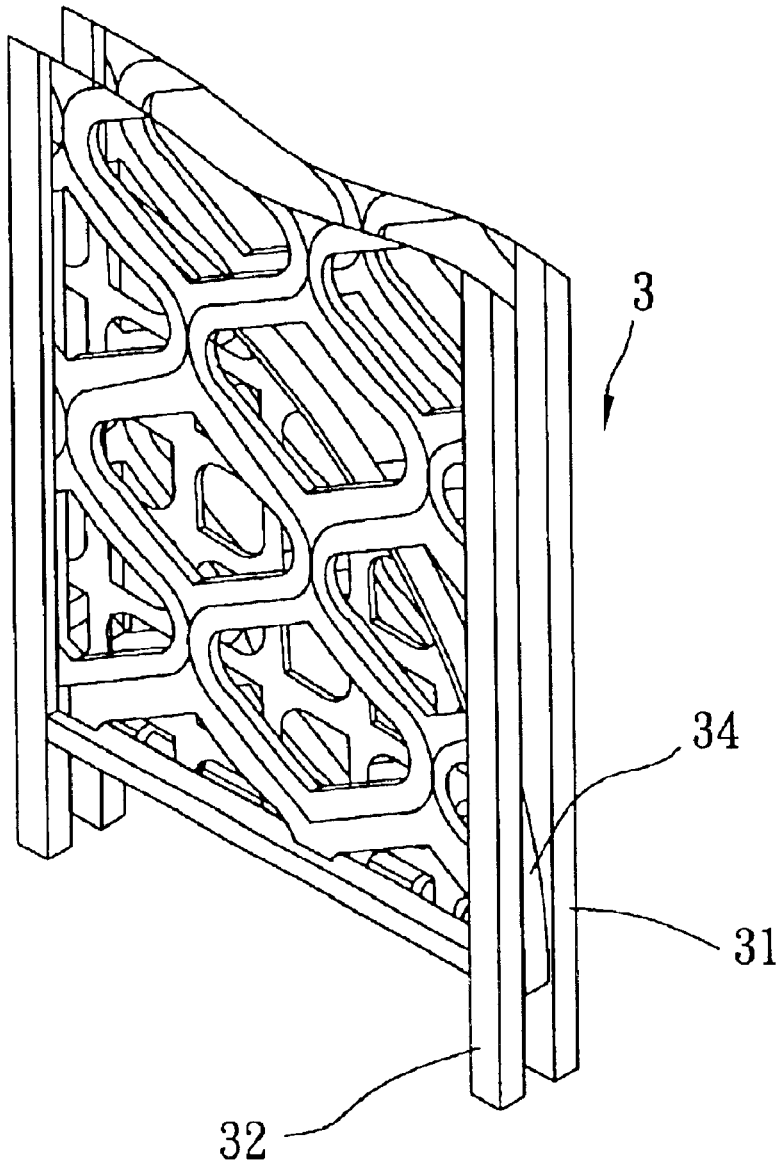
FIG. 6 illustrates the support member of FIG. 3 in a folded state.

To disassemble the leg assembly 2, the vertical plates 41 of the link members 4 are initially removed from the support members 3, and are folded in a manner shown in FIG. 8 in phantom lines so as to shorten the length of each of the link members 4 for storage. Afterwards, the support members 3 are folded by disengaging the positioning pins 345 on the linking sides 342 of the connecting plates 34 of the support members 3 from the insert holes 324 in the positioning units 323 so that the connecting plates 34 can be folded on the first leg frames 31. The second leg frames 32 of the support members 3 are then turned toward the first leg frames 31 of the support members 3, thereby clamping the connecting plates 34 of the support members 3 between the first and second leg frames 31, 32, as best illustrated in FIG. 6.

The structural design of the leg assembly 2 of the present invention is not limited to include four upright support members 3. The leg assembly can be modified to include three upright support members 3 and three horizontal link members 4 without affecting the ability.

From the above description of the leg assembly 2 of the present invention, it can be seen that the leg assembly 2 can support the canopy 20 more stably due to the configuration of the support members 3. Furthermore, the presence of the connecting plates 34 on each of the support members 3 for disposal of heavy objects can help enhance stability of the leg assembly 2. Moreover, since the support members 3 and the link members 4 are foldable, the leg assembly 2 can be stored without occupying too much space.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A leg assembly for a canopy said leg assembly comprising:

three upright support members, each of which includes an adjacent pair of planar first and second leg frames that are connected pivotally to each other, and at least one connecting plate disposed between said first and second leg frames so as to be adapted to position said first and second leg frames relative to a ground surface, each of said first and second leg frames including a vertical pivot side and a vertical free side opposite to said pivot side, and being rotatable about a vertical axis between an unfolded position, wherein said free sides of said first and second leg frames of a respective one of said support members are spaced apart from each other so as to form an angle therebetween, and a folded position, wherein said free sides of said first and second leg frames of the respective one of said support members are close to each other; and three horizontal link members, each of which is connected detachably to an adjacent pair of said support members so as to interconnect and position said support members relative to one another;

wherein each of said support members further includes at least one pivot assembly that interconnects rotatably said pivot sides of said first and second leg frames of the respective one of said support members and that includes two pivot seats, each of which is connected to a respective one of said pivot sides of said first and second leg frames of the respective one of said support members, and a pivot pin extending through said pivot seats so that each of said first and second leg frames can rotate about the vertical axis;

wherein said first leg frame of each of said upright support members includes at least one integral horizontal bar, said second leg frame of each of said upright support members including at least one positioning unit that is proximate to said free side and that includes an insert hole, each of said connecting plates being shaped as a circular sector and including a straight pivot side connected pivotally to said horizontal bar of a respective one of said first leg frames, a straight linking side perpendicular to said straight pivot side so that the angle between said first and second leg frames of the respective one of said support members when at the unfolded position is 90°, and a curved side interconnecting said straight pivot side and said straight linking side, said straight linking side being provided with an integral projection that extends toward a respective one of said second leg frames, and a positioning pin that extends downwardly from said projection and that engages detachably said insert hole in said positioning unit of the respective one of said second leg frames when said first and second leg frames of the respective one of said support members is at the unfolded position, said positioning pin being turnable to disengage from said insert hole so that said connecting plate can rotate to abut against said first leg frame of the respective one of said upright support members, thereby permitting folding of said second leg frame on said first leg frame of the respective one of said upright support members when said link members are removed from said support members.

2. The leg assembly of claim 1, wherein each of said horizontal link members includes a pair of vertical plates, which are aligned with each other along a horizontal direction, each of said vertical plates having a pivot end and an engaging end opposite to said pivot end, said pivot ends of said vertical plates of each of said horizontal link members being connected pivotally to each other so as to permit folding of said vertical plates on each other when said horizontal link members are removed from said support members, said engaging end of each of said vertical plates being formed integrally with a downwardly extending insert pin, said free side of each of said first and second leg frames being formed integrally with a lug that has a vertical hole for receiving a respective one of said insert pins therein, thereby attaching detachably said vertical plates of said horizontal link members to said support members.

* * * * *